US005628356A

United States Patent [19]

Marocco

[11] Patent Number: 5,628,356

[45] Date of Patent: May 13, 1997

[54] COMBINED TILT AND LIFT CONTROL FOR WINDOW COVERINGS

[76] Inventor: Norbert Marocco, 46 Pennycross Crt., Woodbridge Ontario, Canada, M4L 3M6

[21] Appl. No.: 611,856

[22] Filed: Mar. 6, 1996

Related U.S. Application Data

[63] Continuation-in-part of Ser. No. 398,819, Mar. 6, 1995, abandoned.

[51] Int. Cl.[6] ..... E06B 9/30

[52] U.S. Cl. ..... 160/170; 160/176.1

[58] Field of Search ..... 160/168.1 R, 176.1 R, 160/170 R, 171 R, 177 R, 173 R, 172 R

[56] References Cited

U.S. PATENT DOCUMENTS

| | | | |
|---|---|---|---|
| 3,269,453 | 8/1966 | Vecchiarelli . | |
| 4,122,885 | 10/1978 | Marotto . | |
| 4,200,135 | 4/1980 | Hennequin | 160/168.1 R |
| 4,350,197 | 9/1982 | Haller . | |
| 4,357,980 | 11/1982 | Rapp | 160/168.1 R |
| 4,377,194 | 3/1983 | Tsuhako | 160/168.1 R |
| 4,621,673 | 11/1986 | Georgopoulos . | |
| 4,799,527 | 1/1989 | Villoch . | |
| 4,875,516 | 10/1989 | Marocco . | |
| 4,928,744 | 5/1990 | Oskam . | |
| 5,123,472 | 6/1992 | Nagashima et al. | 160/176.1 R X |
| 5,228,491 | 7/1993 | Rude et al. | 160/168.1 X |

FOREIGN PATENT DOCUMENTS 1017005 1/1966 Germany .

OTHER PUBLICATIONS

Bali–Ultra Blind Photocopy of parts drawing.

*Primary Examiner*—David M. Purol

[57] ABSTRACT

A combined tilt and lift control, for use with a window covering having slats suspended by ladder tapes connected to the slats, and slat lift elements for raising and lowering the slats and a tilt and lift control rod for operating the combined tilt and lift control, the tilt and lift control having a drum for securing and operating the ladder tapes and defining a hollow interior, a lift element opening in the drum bearings, a lift reel rotatably mounted in the drum, a two way rotation control connecting between the lift reel and the drum so that operation of the tilt and lift control rod between predetermined limits will be transmitted to the drum to cause movement of the ladder tapes and tilting of the slats, and so that movement of the tilt and lift control rod beyond such limits, will release the lift reel from the drum and cause operation of the reel independently of the drum.

22 Claims, 6 Drawing Sheets

COMBINED TILT AND LIFT CONTROL FOR WINDOW COVERINGS

This application is a Continuation in Part of application Ser. No. 398,819, filed Mar. 6, 1995, entitled Combined Tilt and Raise Control for Window Coverings, inventor Norbert Marrocco now abandoned.

FIELD OF THE INVENTION

The invention relates to a combined and tilt and lift control for window coverings.

BACKGROUND OF THE INVENTION

Window coverings for windows, and doors, and the like usually have horizontal slats made of wood, plastic, metal, or the like. The slats are suspended in horizontal parallel spaced apart relation from a head rail. Ladder tapes are suspended from the head rail and are connected to each slat. Lift cords are provided for raising the slats upwardly, and for lowering them downwardly. A lift control permits the lift cords to be raised and lowered.

In addition, a tilt control is provided which is connected to the ladder tapes. Operation of the tilt control will tilt all of the slats one way or the other between open and closed position.

All of this is well known in the art and requires no further description. It is however known that in most cases such window coverings require two separate set of controls, namely, a tilt control for operating the tilting of the ladder tapes, and a lift control for operating the lift cords.

It is desirable to provide for a combined tilt and lift control for operating both tilt and lift functions from a single set of controls. In this way operation of one set of controls will permit the slats to be either raised or lowered, and operation of the same set of controls, in a slightly different mode will cause tilting of the slats.

BRIEF SUMMARY OF THE INVENTION

With a view to providing a combined tilt and lift control for window coverings the invention comprises a control, for use with window coverings having a head rail, slats suspended from said head rail by ladder tapes extending from said head rail and connected to said slats, and slat lift elements extending from said head rail for raising and lowering said slats, and a tilt and lift control rod in said head rail for operating said combined tilt and lift controls, and means for operating said tilt and lift control rod, said tilt and lift control comprising, drum means for securing and operating said ladder tapes and defining a hollow interior, a lift element opening defined by said drum means, lift control bearing means within said drum means, a lift control reel means rotatably mounted in said bearing means within said drum means, two way rotation control means located within said hollow interior of said drum means and connecting between said lift element reel means and said drum means, whereby operation of said tilt and lift control rod between predetermined limits will be transmitted to said drum means to cause movement of said ladder tapes and tilting of said slats, and wherein movement of said tilt and lift control rod beyond said limits, will release said lift control reel means from said drum means and cause operation of said lift control reel means independently of said drum means.

A further feature of the invention is a provision of rotation control means incorporating spring means, mounted on said lift control reel means within said hollow interior of said drum means, and having spring arm portions interengagable with said drum means, and abutment means interengagable with said spring arm portions, whereby to cause said spring arm portions to turn said drum means in one mode, and releasing said lift control means in another mode, to turn independently of said drum means.

A further feature of the invention provides a mounting bearing means for rotatably supporting said drum means and said lift control reel means, and retention means for retaining the same in said head rail.

A further feature of the invention provides a drum means consisting of an essentially cylindrical drum member, and an annular slot extending partially around said drum member and extending therethrough, between its ends, and ladder tape retention means formed on the exterior of said drum means.

A further feature of the invention provides a guide slot in said mounting bearing means, through which said raise element may be passed, into engagement with said lift control reel means.

A further feature of the invention provides a lift control reel means consisting of an elongated body member, reel bearing means at each end of said body member, and a pair of reel cheeks, formed integrally with said body member and extending radially outwardly therefrom, and defining a generally annular shape, having a diameter greater than the cross-section of said body member, and being spaced apart to receive said lift element.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
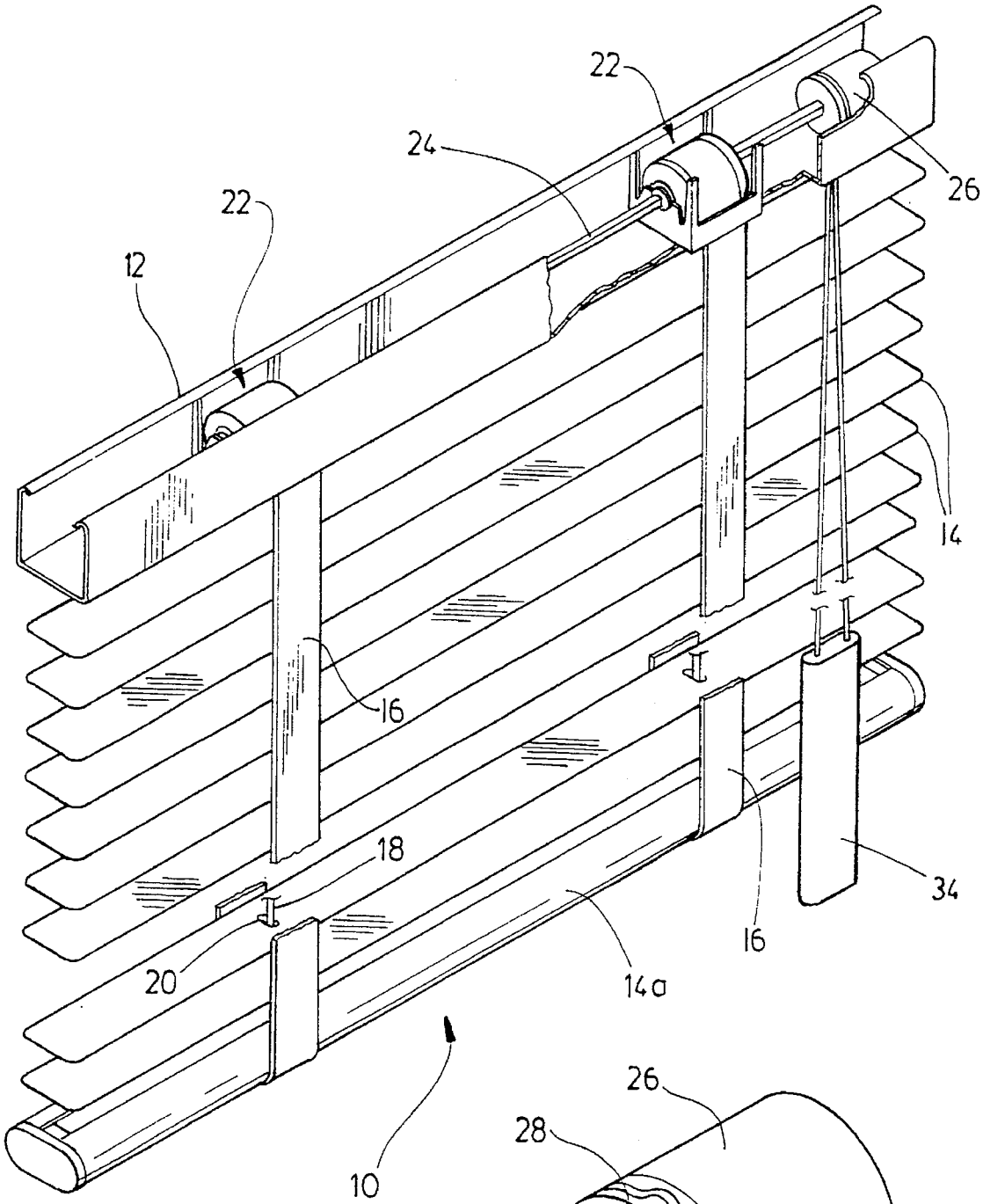
FIG. 1 is a perspective partially cut away illustration of typical window coverings, incorporating a combined tilt and lift control illustrating the invention.
Figure 2:
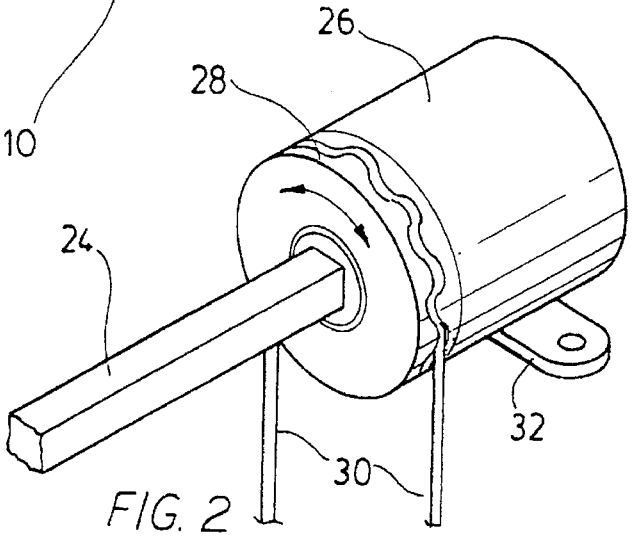
FIG. 2 is a perspective illustration, in isolation, showing the combined and tilt and lift pulley drive for rotating the tilt and lift rod.

Referring to FIG. 1, the invention is illustrated there in the form of a window covering such as the slatted blind indicated generally as 10. Window covering 10 has a head rail 12 of generally rectangular U-shaped construction. A plurality of slats 14 are located spaced below the head rail 12. Usually an oversize lower end slat 14*a* is provided so as to act as a mass, to ensure free operation, in a manner well known in the art.

The slats 14 are supported by means of ladder tapes 16, which may be attached to the slats, along each edge, where the tapes overlie the slats, or alternatively may have transverse rung portions (not shown) well known in the art, which extend underneath the slats, and support them.

In a manner to be described below, operation of the ladder tapes will tilt the slats one way or the other to open and close the window coverings.

In addition to the ladder tapes, there are provided lift elements 18. The lift elements 18 are connected to the bottom rail 14*a*, and extend freely through openings 20 in the slats 14. Operation of the lift elements, in a manner to be described below, causes the slats to be raised upwardly, or lowered downwardly.

Within the head rail 12 there are provided two or more combined tilt and lift controls 22—22 depending on the numbers of ladder tapes and raise elements. They are connected to a tilt and lift control rod 24, which is usually so shaped that it can transmit a rotational drive. In a typical case the rod 24 may be of square or rectangular cross-section. However many other different cross-sections are known.

The ladder tapes 16 are connected in a manner to be described below to the tilt and lift control elements 22—22, and the lift elements 18 are also connected to portions of the tilt and lift controls 22—22 in a manner described below.

The rod 24 extends into a rotary drive coupling 26. The drive coupling 26 may in some cases be motorized, and operated by remote switches (not shown). In the present case the drive 26 is shown as operated manually by means of a pulley 28, and an endless operating cord 30 extending around pulley 28.

The drive 26 may be a direct drive in some cases. However preferably the drive is a reduction gear drive, typically for example a planetary gear drive system, of a type well known in the art, and therefore not illustrated. The purpose is to cause the shaft 24 to rotate one rotation, for every three to four rotations of the pulley 28, in a typical case. Various other ratios may be provided in well known manner. The drive 26 may be secured in the head rail 12 by any means such as the flanges 32. A weight 34 may be provided to hold the loop of the endless cord 30 down, so that it always rides in the pulley 28.

Such drive mechanisms are well known in the art and require no further description.

Figure 3:
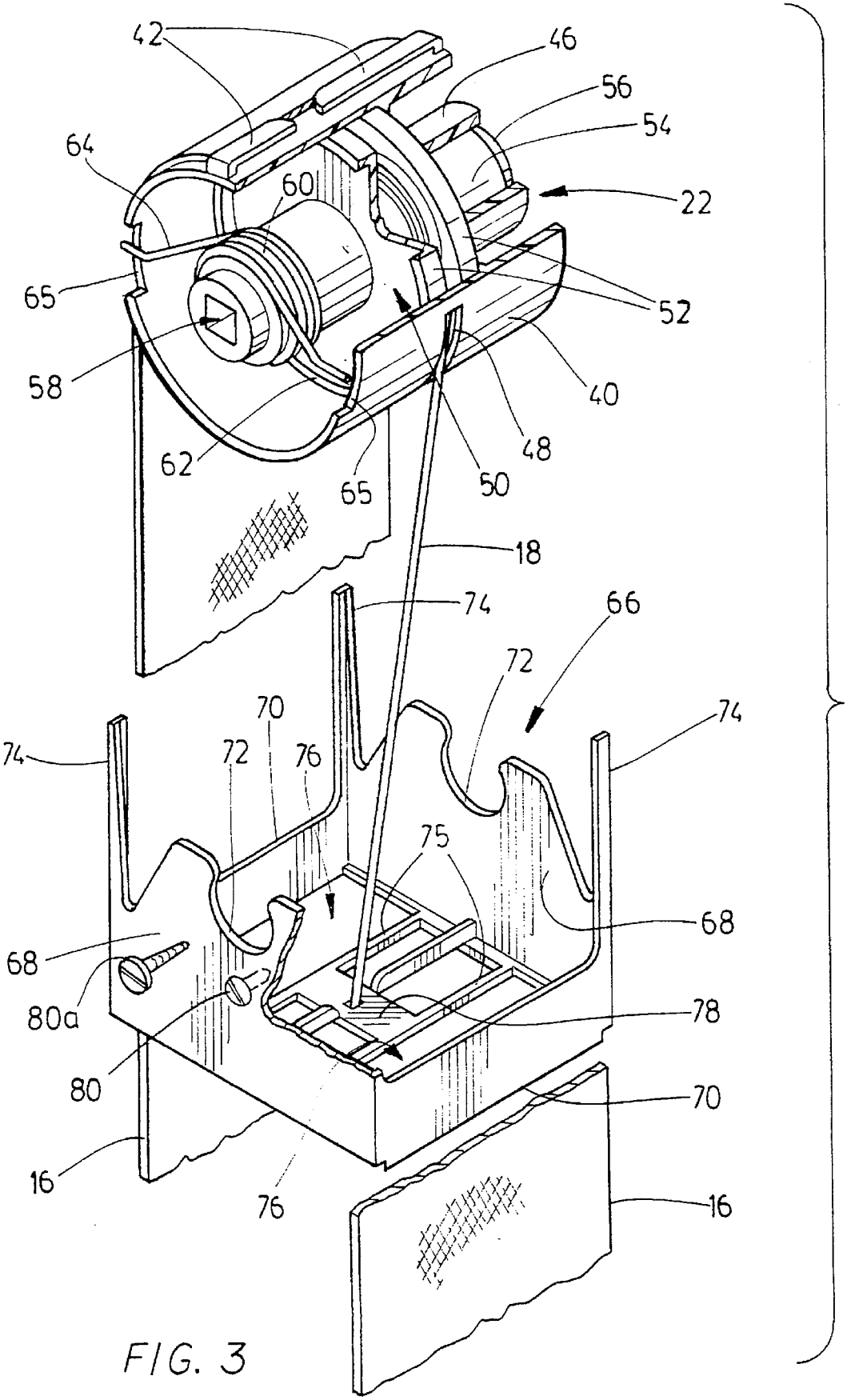
FIG. 3 is an enlarged exploded perspective view of one of the tilt and lift controls of the window covering of FIG. 1.
Figure 4:
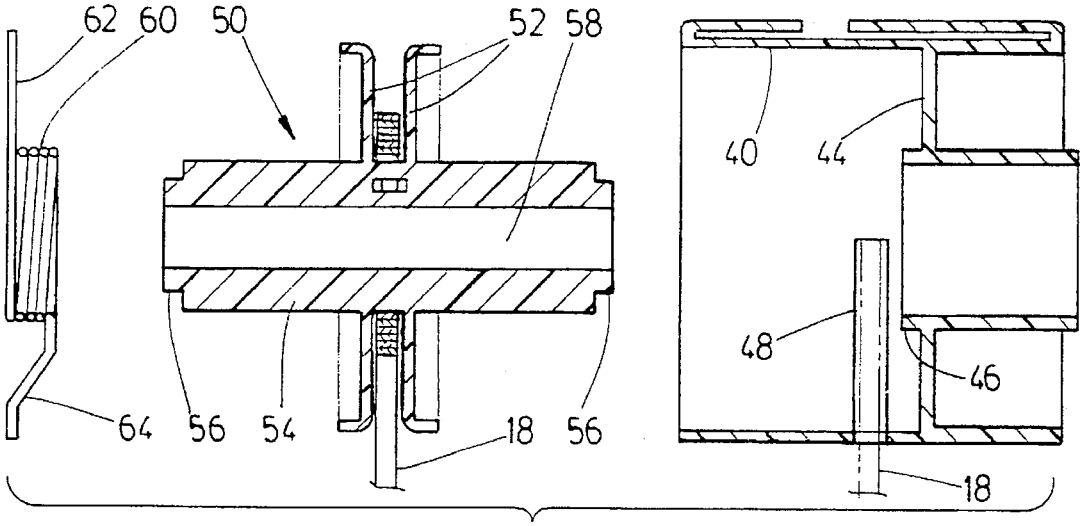
FIG. 4 is a exploded sectional view of the tilt and lift control of FIG. 3.

Referring now to FIGS. 3 and 4, the tilt and lift control will be seen to comprise a relatively large diameter drum body 40, which in this case is of generally cylindrical shape having a hollow interior, and is open at both ends. Ladder tape retainers 42 are provided on the exterior of the body 40, for engaging the ends of the ladder tapes 16.

Within the the hollow interior of drum 40 there is provided a generally circular inner mounting wall 44 (FIG. 4), and an inner cylindrical bearing sleeve 46 is mounted on the wall 44.

A partly annular slot 48 extends through drum 40, for receiving a lift element 18.

Within the hollow interior of drum 40, there is provided a rotatable lift element reel 50. Reel 50 comprises a pair of reel cheeks 52—52, integrally formed with a central reel mounting body 54. Body 54 has reduced diameter end bearings 56 at each end, and has a through opening 58 shaped to receive the rod 24 in driving engagement. The body 54 is of cylindrical shape and is rotatably received in bearing sleeve 46.

The reel cheeks 52 define a spacing which registers with the slot 48.

In order to transmit rotational movement from the body 54 to drum 40 a two way rotation control is provided, which in this case is a helical spring 60 located within the hollow interior of drum 40 and having outwardly extending end arms 62 and 64. The spring 60 is wound so as to make a snug frictional driving fit on the exterior of body 54.

Outward flexing of either of the arms 62 or 64 will however slightly expand the spring 60 thereby releasing it from the body 54.

While in this embodiment, the two way rotation control is illustrated in the form of a single helical spring having two end arms, it will be appreciated that there could be two or more such springs, and such springs may be made out of wire, or for example, resilient plastic material typically moulded in a helical manner.

In order to transmit drive from the arms 62 and 64 to the drum 40, the drum 40, in this embodiment, is provided with notches 65, receiving the respective arms. Notches 65 allow for some free movement of the arms 62, 64. The drum 40, and reel 50 are together rotatably received in a bearing mounting 66 (FIG. 3). Bearing mounting 66 comprises two bearing end walls 68 connected by side walls 70. End walls 68 define bearing recesses 72. Four retention fingers 74 extend upwardly from the end walls 68, to frictionally retain the bearing mounting 66 in the head rail 12.

A pair of spacer rails 75 extend between end walls 68, and define together with side walls 70, elongated open spacings 76 for passage of the ladder tapes 16.

Guide ribs 78 extend between rails 76 and define a guide recess for receiving lift element 18.

The head rail 12 is provided with a suitable rectangular opening (not shown) registering with end walls 68 and side walls 70, so as to permit the ladder tapes 16, and lift element 18 to pass freely therethrough.

The lift element 18 passes through the annular slot 48 and is wound up on the reel 50, between the two cheeks 52. The lift element 18 typically will be a narrow flat filament somewhat in the shape of a small tape, so that it will wind and unwind smoothly on itself.

In order to provide for different modes of operation, a stop member, such as a screw 80, or the like is provided on end wall 68, and extends into the open end of drum 40, to engage with one or other of arms 62, 64. This will occur when the slats are fully rotated one way or the other. A second stop member 80*a* could be used where the blind has narrower (i.e. one inch) slats, to reduce the arc of rotation from stop to stop.

Figure 5:
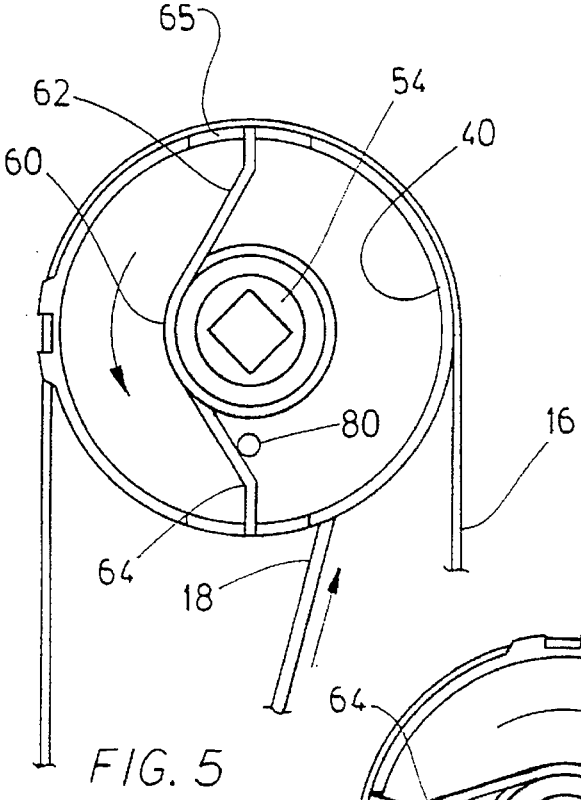
FIG. 5 is a schematic end view showing one mode of operation of the tilt and lift control.

In operation, when the body 54 of the reel 50 is rotated to the left (FIG. 5) and rotate the slats closed (one way or the other). Arm 64 will then engage stop 80. Further rotation of body 54 will cause the arm 64 to flex the spring open, thereby releasing the grip of the spring on the body 54. This will allow the body 54 to rotate, without causing rotation of the drum 40. Reel 50 will thus rotate and wind up the lift element 18.

Figure 6:
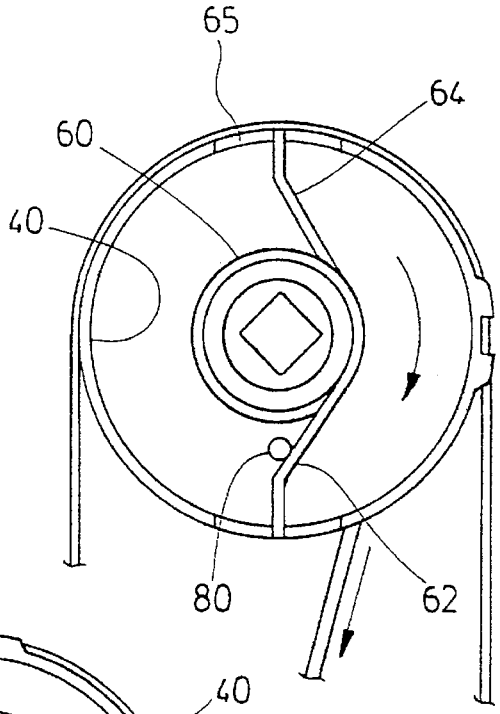
FIG. 6 is a schematic end view corresponding to FIG. 5 showing another mode of operation.

In the opposite mode of operation when the body 54 is rotated to the right (FIG. 6) the slats will tilt the other way and the arm 62 will engage stop 80. This will again cause the arm 62 to flex the spring, opening the spring 60 and releasing the body 54 so that it can rotate and thus unwind the lift element 18.

Figure 7:
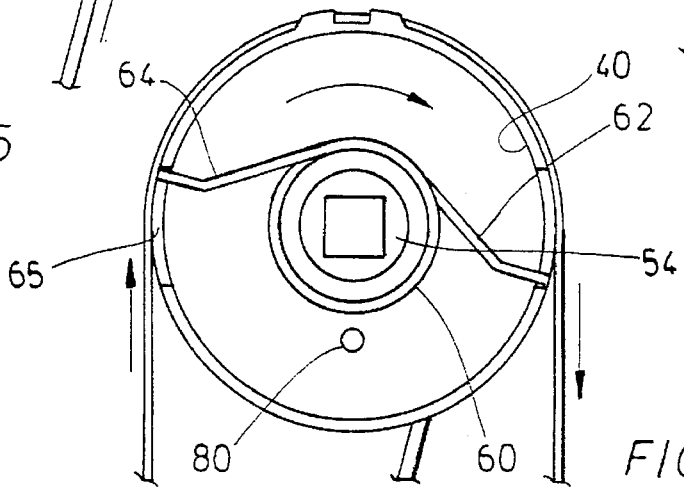
FIG. 7 is a schematic end view showing a third mode of operation.

Between these two positions (FIG. 7) when the body 54 is partially rotated, then neither arm 64 nor arm 62 will contact the stop 80. In this position, the spring 60 will bind on the body 54, and the arms 62 and 64 will engage the drum 40, causing the drum 40 to partially rotate, This will then cause tilting, one way, or the other, of the slats.

Figure 8:
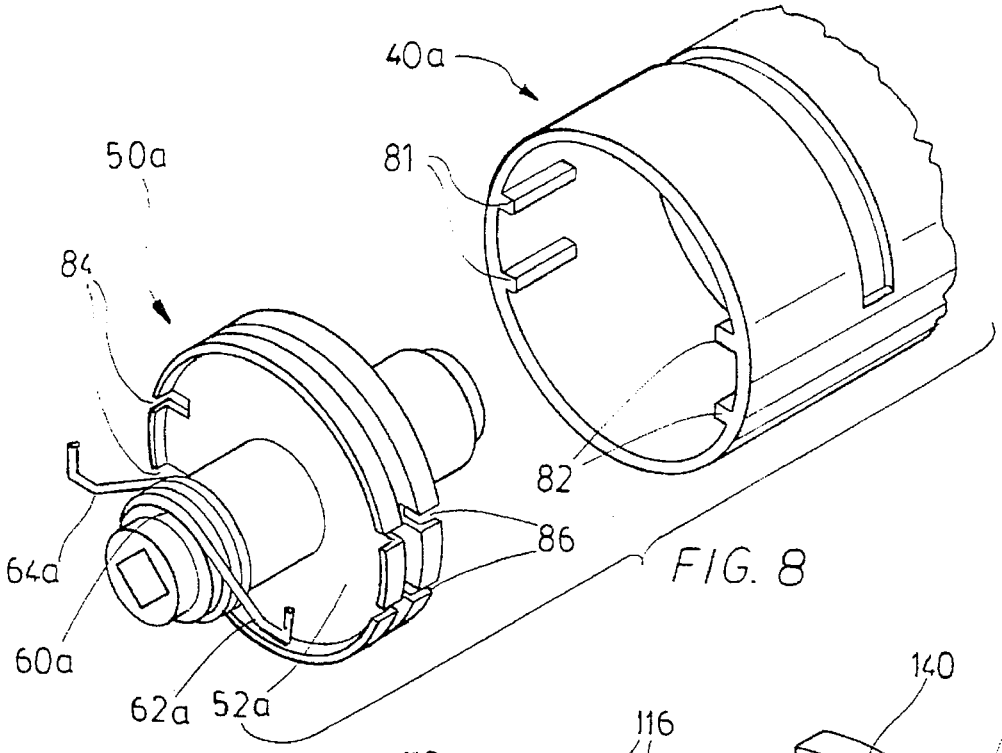
FIG. 8 is a schematic perspective illustration, exploded and illustrating an alternate embodiment of the lift control of FIGS. 3 and 4.
Figure 9:
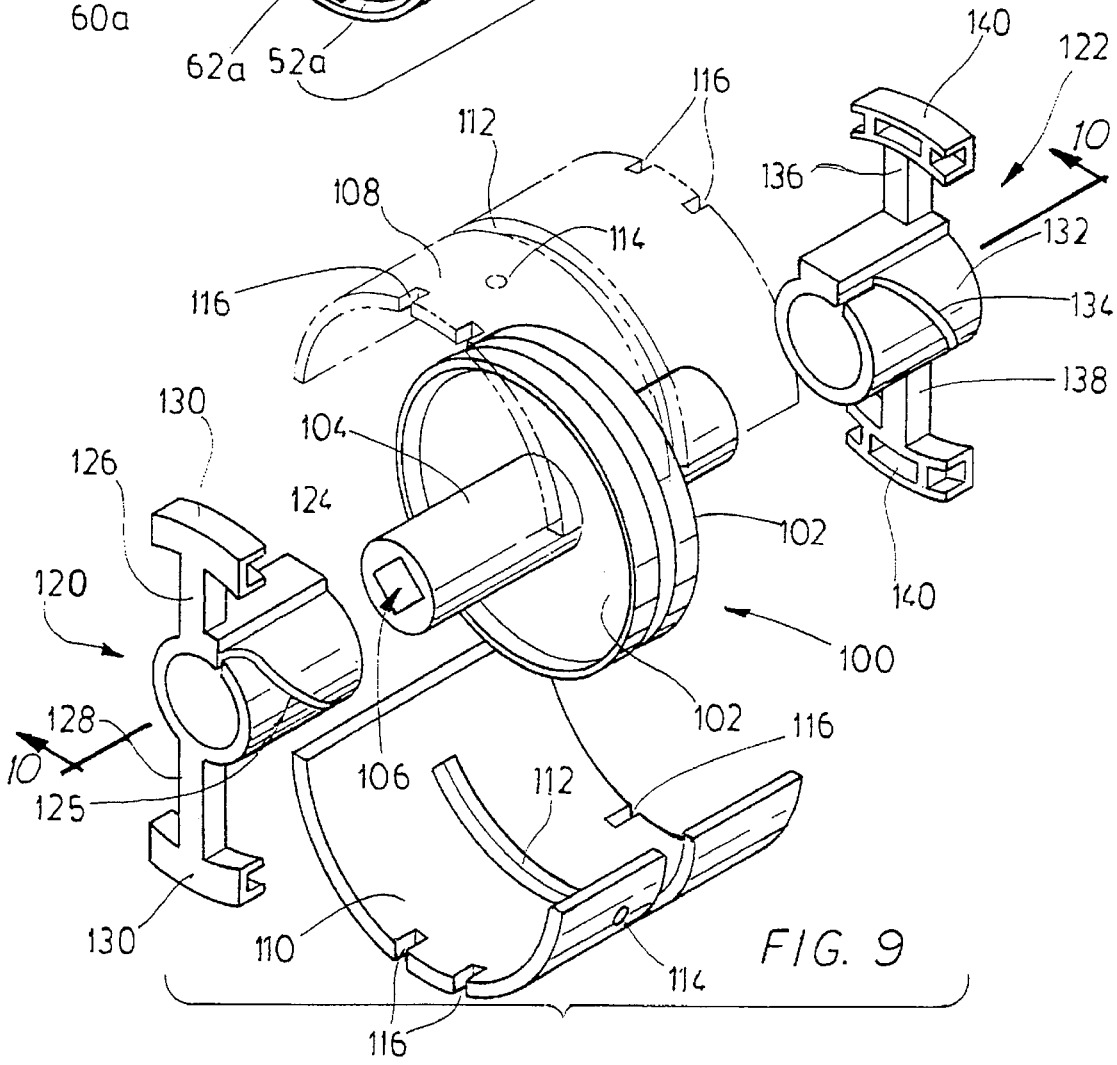
FIG. 9 is an exploded perspective illustration of an alternate form of tilt and lift control, illustrating two spring means, and a split tape drum.

A further embodiment of the invention is illustrated in FIG. 8.

In this illustration, a modified form of drum 40*a* is formed with pairs of spaced apart interior ribs 81 and 82, mutually opposed across a diameter of the drum.

A modified form of reel 50*a* is provided. In this modification, the cheeks 52*a* are formed with pairs of notches 84 and 86 spaced apart from one another and located approximately on either side of the reel on a diameter of the reel. The notches 84, 86 are designed to register with the ribs 80, 82.

The arms 62*a*, 64*a*, of the spring 60*a* are slightly shorter than in the embodiment of FIGS. 2 through 7, and are designed to fit within the drum 40*a*, and remain captive between respective pairs of ribs 80 and 82, but, moveable around the arc confined by those respective pairs of ribs.

The purpose of the grooves in the reel is simply to permit the insertion of the reel within the hollow interior of the drum, past the ribs 80 and 82 during assembly.

A further embodiment of the invention is illustrated in FIGS. 9, 10, 11, and 12.

In this embodiment, a reel 100 is provided, generally similar to reel 50 of the embodiment of FIGS. 2 through 7. The reel 100 has cheeks 102, for winding up a lift element. It is mounted on a central body 104 having a drive opening 106, to receive a tilt and control rod (not shown).

In this embodiment, a drum assembly is provided consisting of two semi-cylindrical drum portions 108 and 110. The drum portions extend around arcs of somewhat less than 180° for reasons described below. Each drum portion is provided with a generally semi-annular slot 112, for receiving the lift element. In addition, cord retention holes 114 are provided, for reasons described below.

Each of the drum portions is provided with a pair of spaced apart notches 116, which are located more or less halfway around the arc of each drum portion and at opposite ends thereof.

In this embodiment, rotation drive control means are provided by means of the two thermoplastic spring assemblies 120 and 122 located within the hollow interior of the drum portions. The spring assembly 120 consists of a generally cylindrical barrel shape helical spring portion 124 defined by helical notch 125, having end arms 126 and 128 connected to the opposite ends of the helical spring portion. Each of the arms 126 and 128 has a drum holding bracket 130 at its end, shaped to interfit with the notches 116.

The spring assembly 122 has a generally cylindrically shaped helical spring portion 132, defined by a helical slot 134. End arms 136 and 138 extend from opposite ends of the helical spring portion. At the free ends of the arms 136, 138, there are located drum connector brackets 140, shaped to interfit with the notches 116 in the drum portions.

The entire assembly (FIG. 10) is arranged to be supported in a bearing mounting bracket 150, having end walls 152, and stop screws 154 in opposite end walls. The stop screws 154 are adapted to engage the arms 126, 128, and 136, 138, respectively of the respective drive connectors 120 and 122.

When assembled, the body 104 of the reel 100 passes through the helical generally cylindrical spring portions 124, 132, and by their inherent bias, the spring portions will provide a gripping frictional drive on the body 104.

Figure 10:
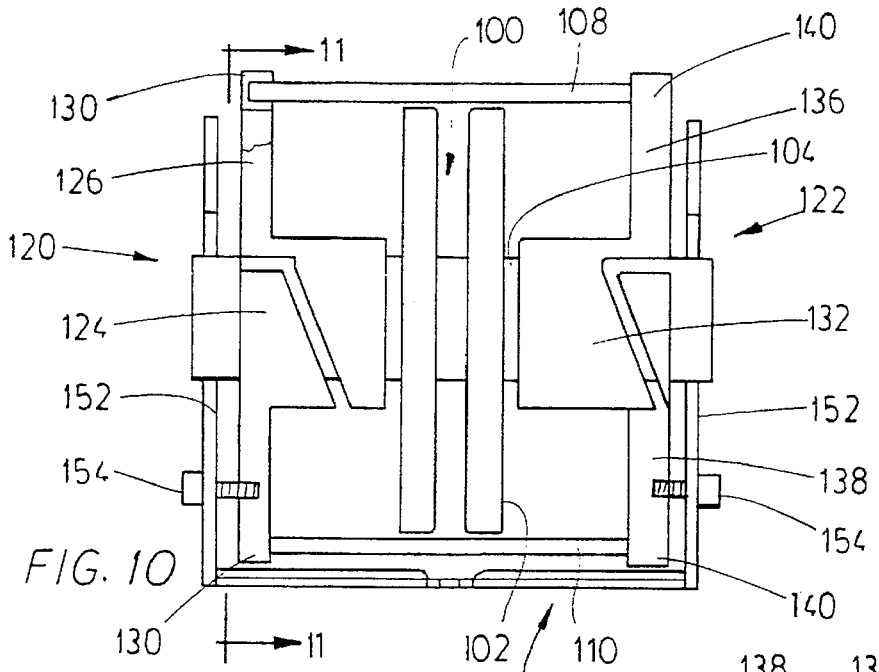
FIG. 10 is a section along the line 10—10 of FIG. 9.
Figure 11:
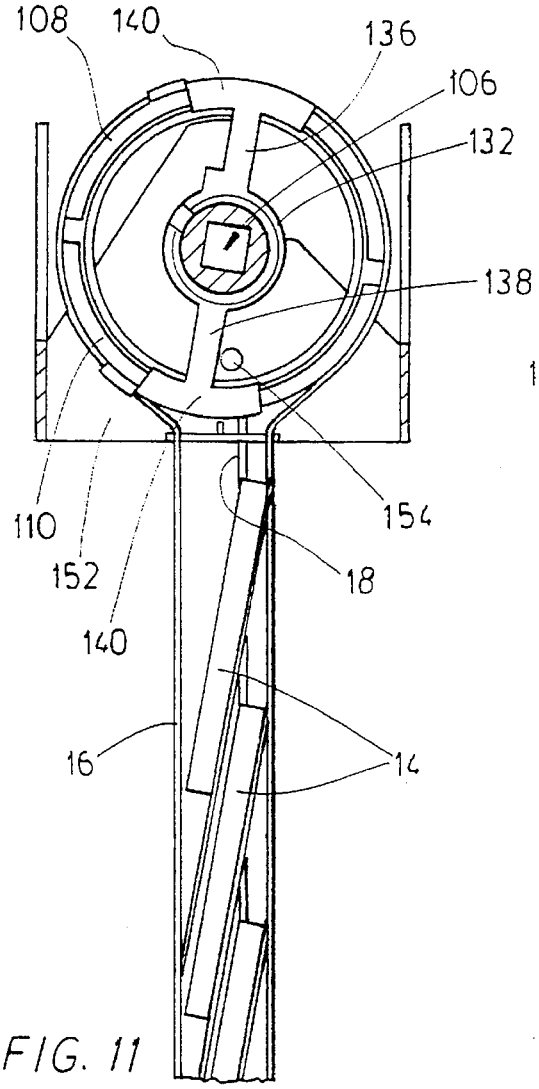
FIG. 11 is a schematic illustration illustrating one mode of operation of the embodiment of FIGS. 9 and 10.
Figure 12:
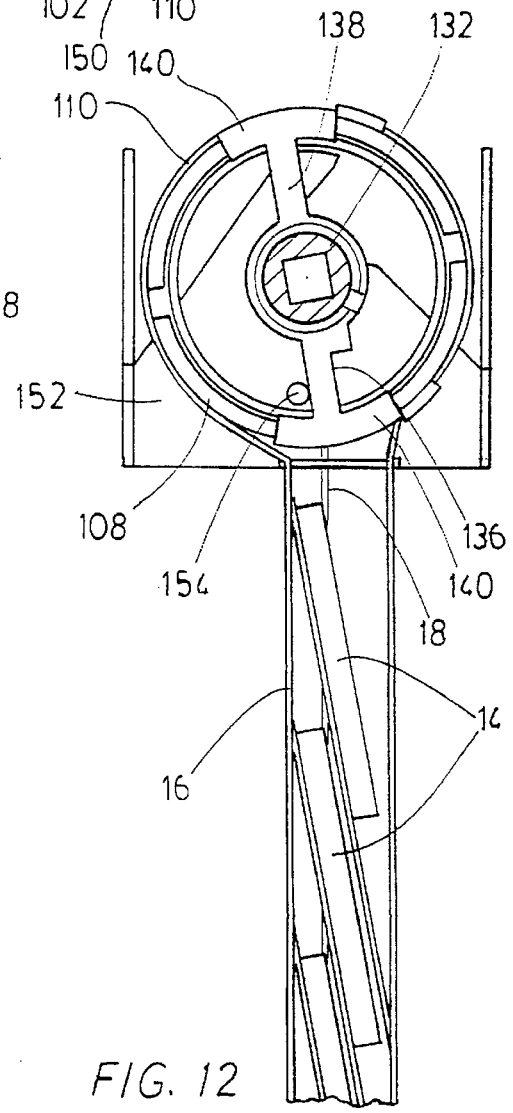
FIG. 12 is a view corresponding to FIG. 11 showing an alternate mode of operation, and, FIG. 13 is an exploded view of an alternate embodiment.

The two drums portions are held between the connectors 130 and 140 on the arms, and define gaps between the edges of the drum portions (FIGS. 10, 11, and 12). As the body 104 is rotated one way, the arms of the respective drive assemblies 120, 122, will abut against the screws 154, either on one side or on the other side (FIGS. 11, and 12). Such abutting will cause the helical spring portions 124, 132 to be flexed open thereby releasing the body 104, so that the reel can be rotated, while the drum portions remain stationary.

Between the two extreme positions, the helical spring portions 124, 132 will grip the body 104. Rotation of the body 104 between the two extreme portions will thus cause rotation of the drum portion, and cause tilting of the ladder tapes.

Stop screws 154 as shown allow for substantially 320° of rotation, from stop to stop. This may be desirable with wider slats. With narrower slats two pairs of such stop screws 154 could be used to reduce the arc of rotation from stop to stop.

Figure 13:
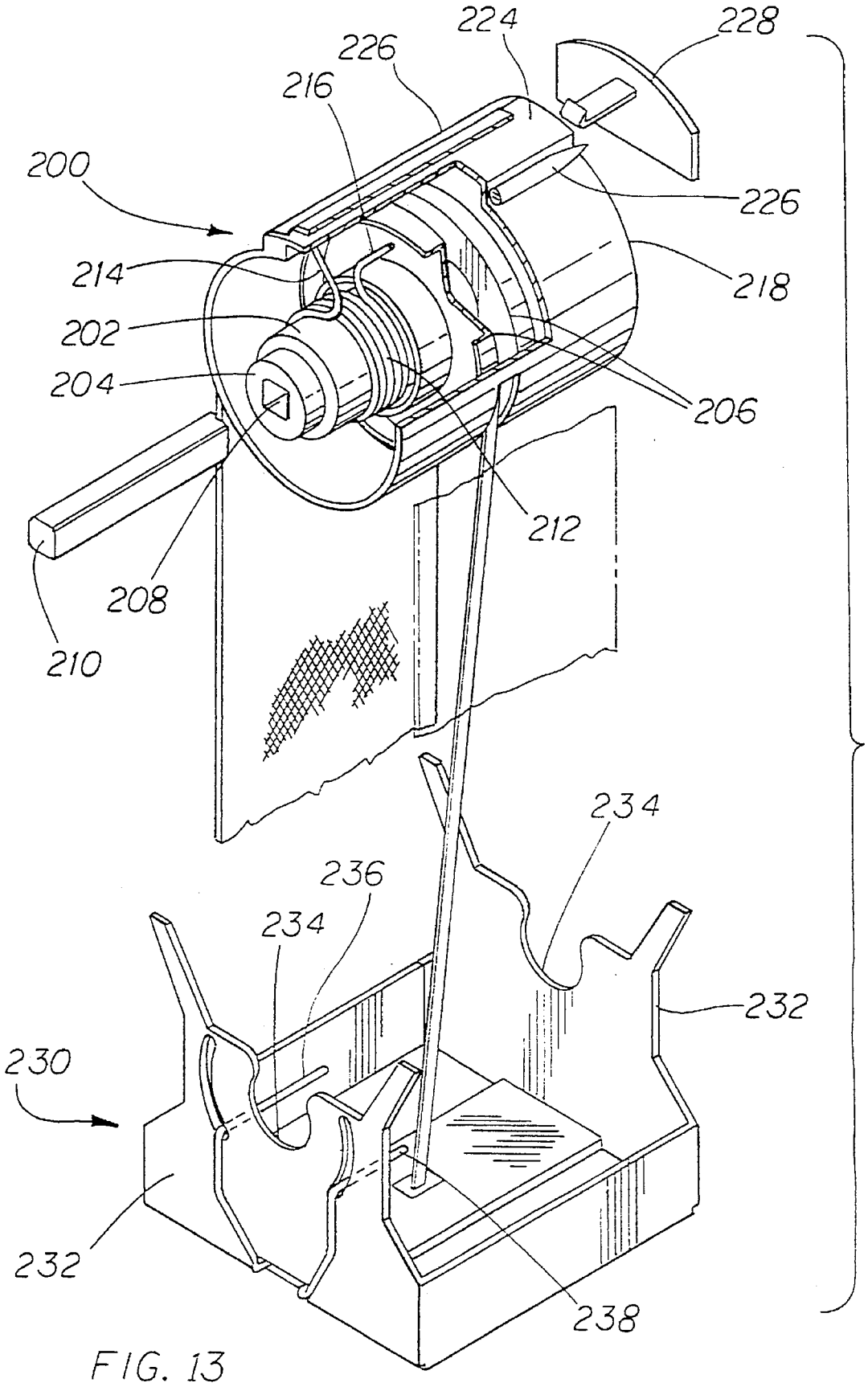

A further embodiment is illustrated in FIG. 13. A reel 200 has a cylindrical reel body 202, with bearings 204 at each end. Cheeks 206 define a lift element receiving enclosure as before. A central drive sleeve 208 is formed integrally, to receive a drive rod 210. A spring 212 is located within the hollow interior of the drum 218 and fits around body 202 and has inturned ends 214 and 216.

A tape drum 218 is formed having partition supporting a sleeve (not shown) similar to FIG. 3. The sleeve rotatably receives body 202. A protruding channel 224 is formed integrally with drum 218, and extends axially therealong. Tape receiving rods 226 are formed on either side of channel 224, and the ladder tapes are fastened around the rods 226. A removable end member 228 fits over the free ends of rods 226 to retain the tapes in position.

A drum support 230 is provided having end members 232 defining bearing recesses 234 for reception of bearings 204 of body 202. Drum support 230 is provided with a pair of wire stop arms 236 and 238, which are in fact formed of a single integral piece of wire captively retained beneath drum support 230.

When assembled the arms 214 and 216 of spring 212 are received in channel 224 within the hollow interior of drum 218. When the body and drum are rotated to the left, the arm 216 will engage one of stops 236–238. Further rotation will cause spring to relax slightly, thus allowing the body 202, and cheeks 206 to continue to rotate, while the drum is held stationary.

When the body and drum are rotated to the right, arm 214 will engage the other of stops 236–238. Again this will relax the spring and allow the body to rotate while holding the drum.

Between these two positions the slats will be only slightly tilted or will be horizontal.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A combined tilt and lift control, for use with a window covering having a head rail, slats suspended from said head rail by ladder tapes extending from said head rail and connected to said slats, and slat lift elements extending from said head rail for raising and lowering said slats, and a tilt and lift control rod in said head rail for operating said combined tilt and lift control and means for operating said tilt and lift control rod, said tilt and lift control comprising;

drum means for securing and operating said ladder tapes and defining a hollow interior;

sleeve means within said drum means and formed integrally therewith;

a lift element opening defined by said drum means;

a lift control reel means rotatably mounted within said drum means;

body means formed as part of said control reel means and rotatably received in said sleeve means;

bearing means defined by said body means for rotatably supporting said body means, said reel means and said drum means two way rotation control means located within the hollow interior of said drum means and connecting between said lift element reel means and said drum means, whereby operation of said tilt and lift control rod between predetermined limits will be transmitted to said drum means to cause movement of said ladder tapes and tilting of said slats, and wherein movement of said tilt and lift control rod beyond said limits, will release said lift control reel means from said drum means and cause operation of said reel means independently of said drum means.

2. A combined tilt and lift control as claimed in claim 1 and including a helical spring, mounted on said body means of said lift control reel means, and having arm portions interengagable with said drum means, and abutment means interengagable with said arm means, whereby to cause said arm portions to turn said drum means in one mode, and stop means operable in another mode to release said lift control means for rotation, independently of said drum means.

3. A combined tilt and control as claimed in claim 1 and wherein said bearing means for rotatably supporting said drum means and said lift control reel means, are retained in retention means in said head rail.

4. A combined tilt and lift control as claimed in claim 1 wherein said drum means comprises an essentially cylindrical drum member, an annular slot extending partially around said drum member and extending therethrough, between its ends, ladder tape retention means on the exterior of said drum means, and bearing means in said drum member to receive said reel means.

5. A combined tilt and lift control as claimed in claim 3 and including a guide in said mounting bearing means, through which said lift element passes, into engagement with said lift control reel means.

6. A combined tilt and lift control as claimed in claim 1 and wherein said lift control reel means includes a pair of reel cheeks, formed integrally with said body member and extending radially outwardly therefrom, and defining a generally annular shape, having a diameter greater than the cross-section of said body member, and being spaced apart to receive said lift element.

7. A combined tilt and lift control as claimed in claim 1 and including spring arm retention ribs formed on the inside surfaces of said drum means, adapted to engage said spring arms.

8. A combined tilt and lift control as claimed in claim 1 wherein said drum means comprises two drum portions of generally semi-cylindrical shape, and engagement means at opposite ends of said drum portions.

9. A combined tilt and lift control as claimed in claim 8 and wherein said rotation control means comprises two spring assemblies positioned at opposite ends of said drum means, and arm portions extending from said spring assemblies, for interengagement with said engagement means of said drum portions.

10. A combined tilt and lift control as claimed in claim 9 wherein said spring assemblies are each formed of thermoplastic material, each having a helical slot therein.

11. A combined tilt and lift control as claimed in claim 1, and wherein said drum means incorporates channel means for receiving opposite ends of said spring.

12. A combined tilt and lift control as claimed in claim 11 and including a support for said drum means and a pair of stop arms attached to said drum support and engageable by respective ends of said spring when said drum means is rotated.

13. A window covering having a head rail, slats suspended from said head rail by ladder tapes and ladder tapes extending from said head rail and connected to said slats and slat lift elements extending from said head rail for raising and lowering said slats and comprising;

a tilt and lift control rod in said head rail for operating said ladder tapes, and said lift elements;

at least two combined tilt and lift controls having hollow drum means for securing and operating said ladder tapes and lift element opening means defined by said drum means;

lift bearing means within said drum means;

lift reel means defining body means rotatably mounted in said bearing means within said drum means;

two way rotation control means mounted on said body means and within the interior of said drum means connecting between said lift reel means and said drum means, whereby operation of said tilt and control rod between predetermined limits will be transmitted to said drum means to cause movement of said ladder tapes and tilting of said slats, and wherein movement of said tilt and lift control rod beyond said limits, will release said lift reel means from said drum means and cause operation of said lift reel means independently of said drum means.

14. A window covering as claimed in claim 13 and wherein said two way control means includes at least one helical spring, mounted on said reel body means within said drum means, and having arm portions interengagable with said drum means, and abutment means on said drum means interengagable with said arm means, whereby to cause said spring arms to turn said drum means in one mode, and stop means engageable with said spring arms in another mode to release said lift means independently of said drum means.

15. A window covering as claimed in claim 13 and including mounting bearing means for rotatably supporting said drum means and said lift reel means, and retention means on said mounting bearing means engageable with said headrail for retaining said mounting bearing means in said head rail.

16. A window covering as claimed in claim 13 and wherein said drum means consists of an essentially cylindrical drum member, and an annular slot extending partially around said drum member and extending therethrough, between its end, and ladder tape retention means on the exterior of said drum member.

17. A window covering as claimed in claim 15 and including a guide in said mounting bearing means, through which said element passes into engagement with said lift reel means.

18. A window covering as claimed in claim 13 and wherein said lift reel means consists of a elongated body member, bearing means at each end of said body member, and a pair reel cheeks, formed integrally with said body member and extending radially outwardly therefrom, and defining a generally annular shape, having a diameter greater than the cross-section of said body member, and being spaced apart to receive said lift element.

19. A window covering as claimed in claim 13 and including spring arm retention ribs formed on inside surfaces of said drum means, adapted to engage ends of said spring arms.

20. A window covering as claimed in claim 13 wherein said drum means comprises two drum portions of generally semi-cylindrical shape, and engagement means at opposite ends of said drum portions.

21. A window covering as claimed in claim 20 and wherein said rotation control means comprise two spring assemblies, positioned at opposite ends of said drum means, and arm portions extending from said spring assemblies, for interengagement with said engagement means of said drum portions.

22. A window covering as claimed in claim 21 and wherein said spring assemblies are each formed of thermoplastic material, each having a helical slot therein.

* * * * *